US006196285B1

(12) United States Patent
Tahvonen

(10) Patent No.: US 6,196,285 B1
(45) Date of Patent: Mar. 6, 2001

(54) WOODEN WORK BENCH TOP WITH FULL LENGTH HYDRAULIC VISE

(76) Inventor: Emil Edward Tahvonen, 13175 Tucker Dr., DeWitt, MI (US) 48820

( * ) Notice: Subject to any disclaimer, the term of this patent is extended or adjusted under 35 U.S.C. 154(b) by 0 days.

(21) Appl. No.: 08/645,412

(22) Filed: May 13, 1996

(51) Int. Cl.[7] ..... B25H 1/00

(52) U.S. Cl. ..... 144/286.5; 144/307; 144/286.1; 269/27; 269/32; 269/289 R

(58) Field of Search ..... 144/286.1, 286.5, 144/306, 307; 269/27, 32, 291, 292, 293, 294, 900, 901, 139, 289 R

(56) References Cited

U.S. PATENT DOCUMENTS 4,154,435 * 5/1979 Alessio ..... 144/286.1
4,155,386 * 5/1979 Alessio ..... 144/286.1
4,375,827 * 3/1983 Ignjatic ..... 144/286.1

* cited by examiner

*Primary Examiner*—W. Donald Bray

(57) ABSTRACT

A work bench top constructed preferably of hardwood dimension lumber of a thickness sufficient to provide the strength and rigidity required for heavy duty work bench use. The bench top consists of two sections, one of which forms the main body of the top and a movable narrower section the same length and thickness as the main section of the top. The narrower or front section of the top is pulled to the main section by hydraulic power and an arrangement of cable and pulleys creating a full length vise. The front section of the top is attached to the main portion or balance of the top by wooden guides that slide into brackets on the underside of the top and by a steel cable attached to eye bolts installed on wooden blocks reinforced by angle iron and attached to this front member of the top. The cable is then threaded around two pulleys mounted on the underside of the main portion of the top and to a third pulley mounted on a metal block also on the underside of the main part of the top. This metal block is attached to the piston of a hydraulic jack. When the hydraulic power is applied the cables attached to the front section of the top pull this front section into the main body of the top creating a powerful clamping action. When the hydraulic power is applied a spring mounted on a guide rod attached on the metal block containing the third pulley is compressed. When the hydraulic power is released this spring forces the hydraulic rod or ram to the closed position releasing the cable tension and the clamping action of the two sections of the bench top. This bench top provides clamping action for irregular or tapered workpieces or round or irregular shaped pieces by the installation of bench dogs in holes provided.

2 Claims, 11 Drawing Sheets

WOODEN WORK BENCH TOP WITH FULL LENGTH HYDRAULIC VISE

BACKGROUND OF THE INVENTION

The invention is a work bench top constructed of lumber preferably of a hardwood species and of a thickness to provide the strength and rigidity required for heavy duty work bench use. This work bench has a full length front portion that is an integral part of the bench top and which when pulled by an arrangement of cable and pulleys and hydraulic power to the larger part of the work top bench creates a full length vise or clamping action. This bench is also equipped with a mechanism for the instant release of the vise and clamping action.

BACKGROUND ART

U.S. Pat. No. 4,155,386 issued May 29, 1979 and U.S. Pat. No. 4,154,435 are portable work benches having clamping action using two threaded rods with crank handles to furnish the clamping power. In each of these benches each threaded rod must be operated independently to secure the jaw opening that is of uniform width or varies from one longitudinal end to the other. In my bench, because of the cable and pulley arrangement, the jaw opening conforms automatically to the workpiece whether tapered or of uniform width or thickness. The patented benches with their threaded rod mechanism, folding legs, and light construction members appear designed for light duty applications. In contrast, this invention is completely assembled, made preferably of dimension lumber and has powerful hydraulic clamping or vise action. The bench top can be taken to construction sites and placed upon saw horses or other supports for one the job use. The bench top can with equal propriety be installed permanently on a work bench base constructed to a user's specifications.

SUMMARY OF THE INVENTION

The invention is a work bench top made preferably of dimension lumber. An integral part of this top is the movable front piece which is attached to the main portion of the top by steel cable and also held in place by two wood guides installed on the underside of the front piece and guide brackets installed on the underside of the larger portion of the top. The bench top can be constructed in various widths and lengths. The cable attached to the eye bolts in the front piece of the top is routed through two pulleys mounted on the underside and to the rear of the top and through a third pulley mounted to a metal block which is mounted to the top of the piston or ram of a hydraulic jack. A metal guide rode is attached to the opposite end of the metal block on which a compression spring is installed. When the jack valve is closed and the jack operated the metal block moves forward tightening the cable attached to the front section eye bolts and routed through the pulleys on the underside of the top. This cable tightening pulls the front section of the top into the main part of the top creating a clamping or vise action. The two sections of the work bench top have thus become the jaws of a full length bench top vise with extraordinary holding power. When the jack valve is opened the return spring which was compressed in the closing action returns the jack piston to the closed position and allows the front piece of the bench to open to a width of approximately 2¼". This measurement can be changed by adjusting the length of the cable and the total length of the hydraulic piston by the use of a different jack or hydraulic pump and rod combination. If the vise is to be used to secure material wider or thicker than the opening provided this is accomplished by the use of bench dogs. The space provided between the wood guides attached to the underside of the front section of the top and the guide brackets attached to the underside of the main or larger section of the bench top allows the front section to be opened at an angle creating a vise or clamping jaw opening having a different width at one longitudinal end of the clamping jaw than the other. This along with the cable moving freely as installed on the pulleys as previously described allows the vise to tighten securely to tapered workpieces as well as to workpieces of uniform thickness or width. Workpieces of a tubular configuration or other configurations can be easily clamped by inserting bench dogs in both sections of the top.

DESCRIPTION OF THE PREFERRED EMBODIMENTS OF THE INVENTION

Figure 1:
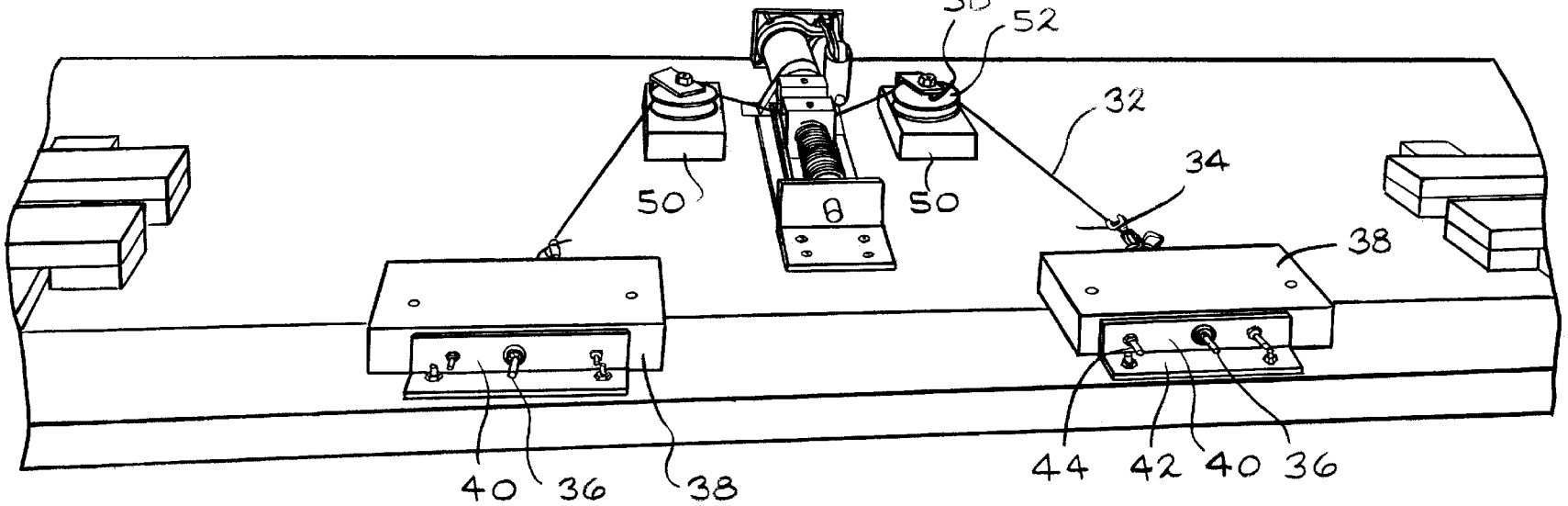
FIG. 1 is a view of the underside of the work bench top showing the operational elements of the invention.
Figure 2:
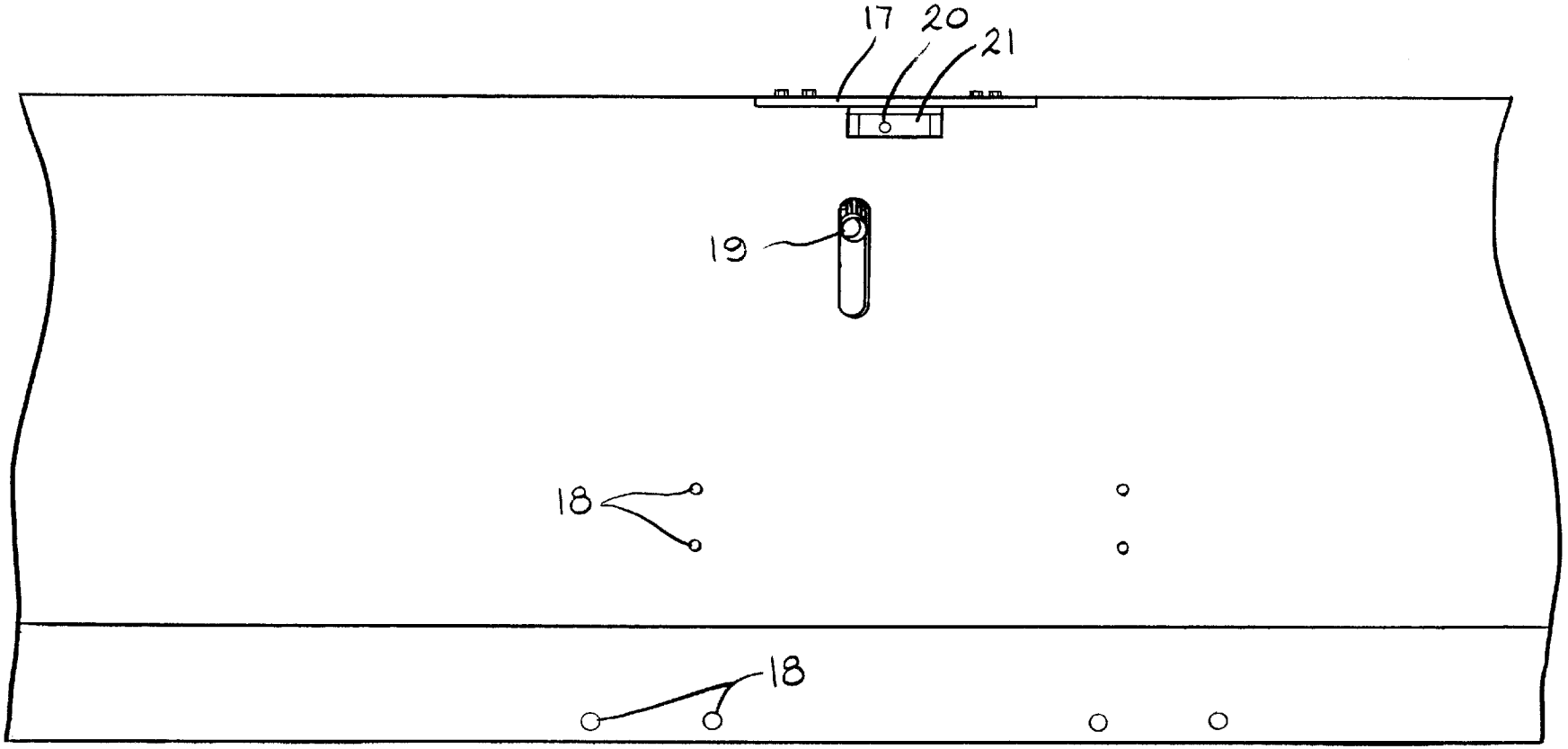
FIG. 2 is a view of the opening or port in the workbench top for the insertion of the hydraulic jack handle and the port or access opening to the jack valve.
Figure 3:
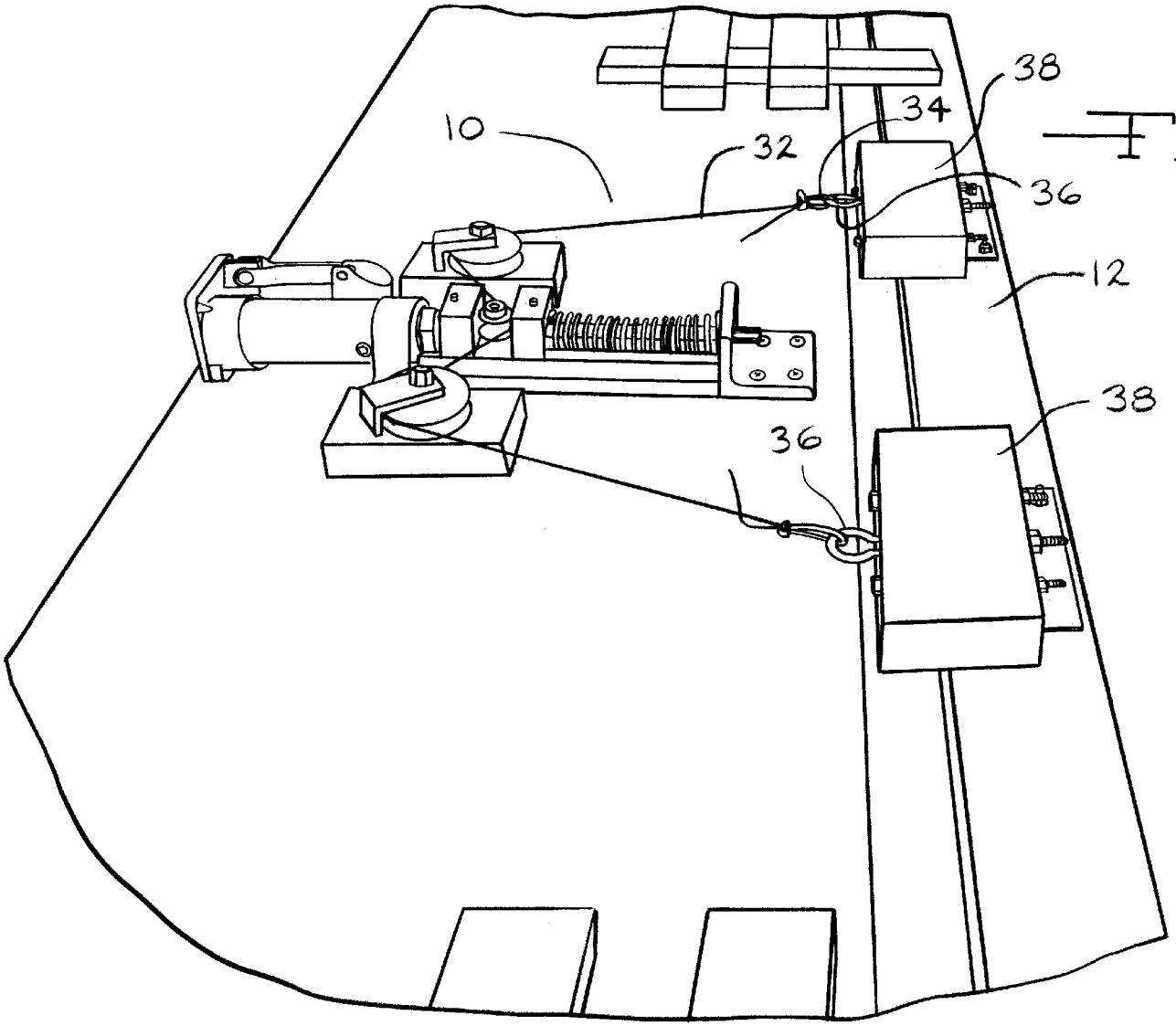
FIGS. 3 and 3A are views of the underside of the top primarily to indicate the open position of the two sections of the top.
Figure 3A:
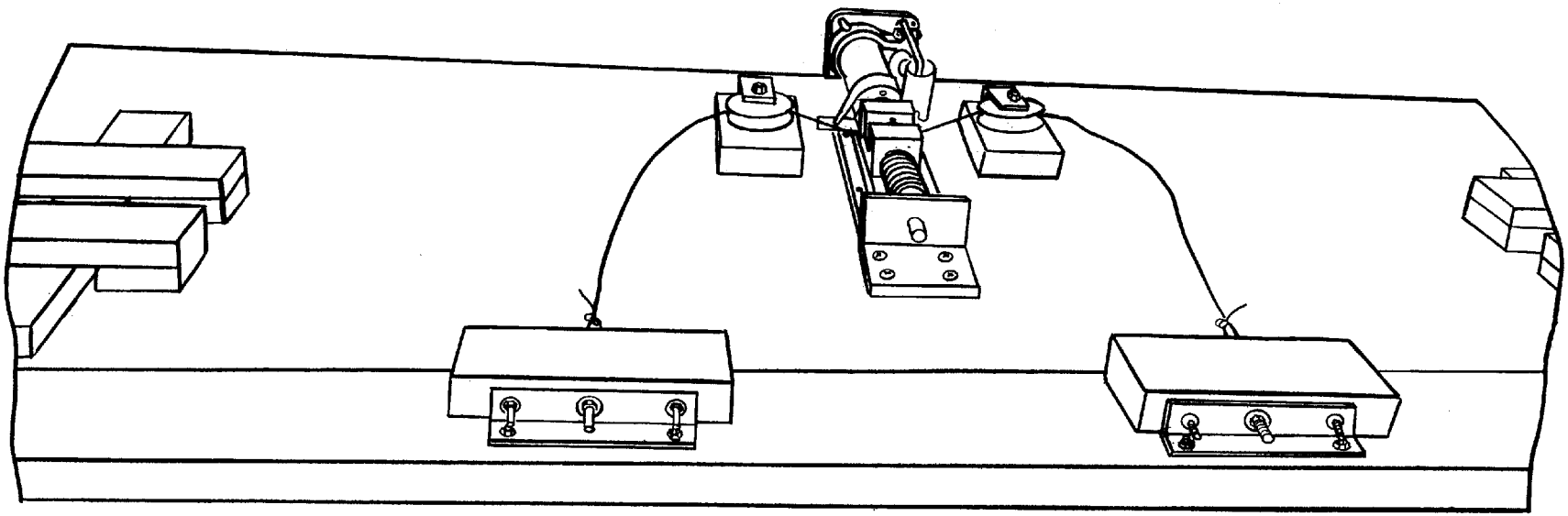
Figure 4:
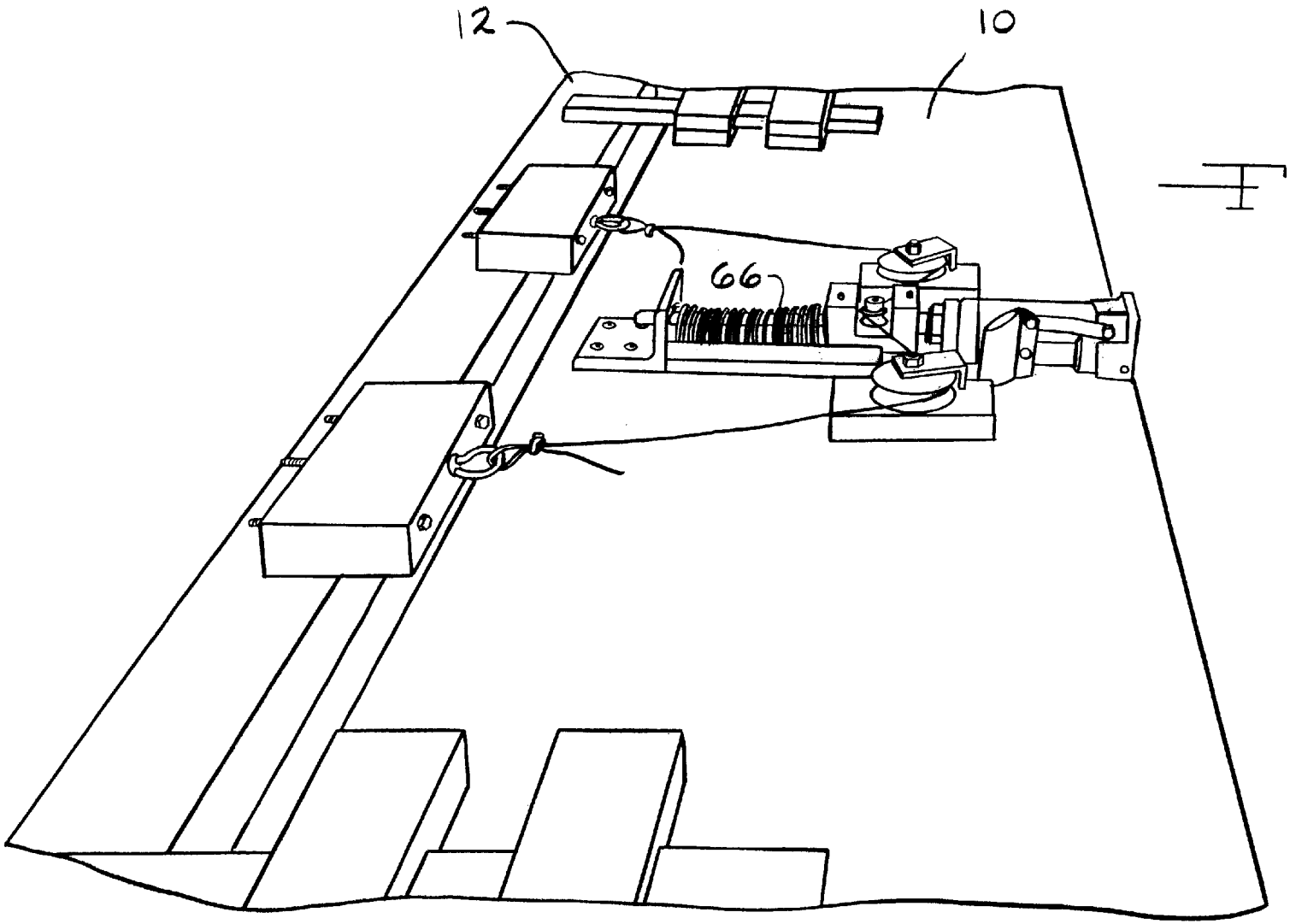
FIG. 4 is a view of the underside of the top indicating the compression spring in the expanded or open position when clamping section is open.
Figure 4A:
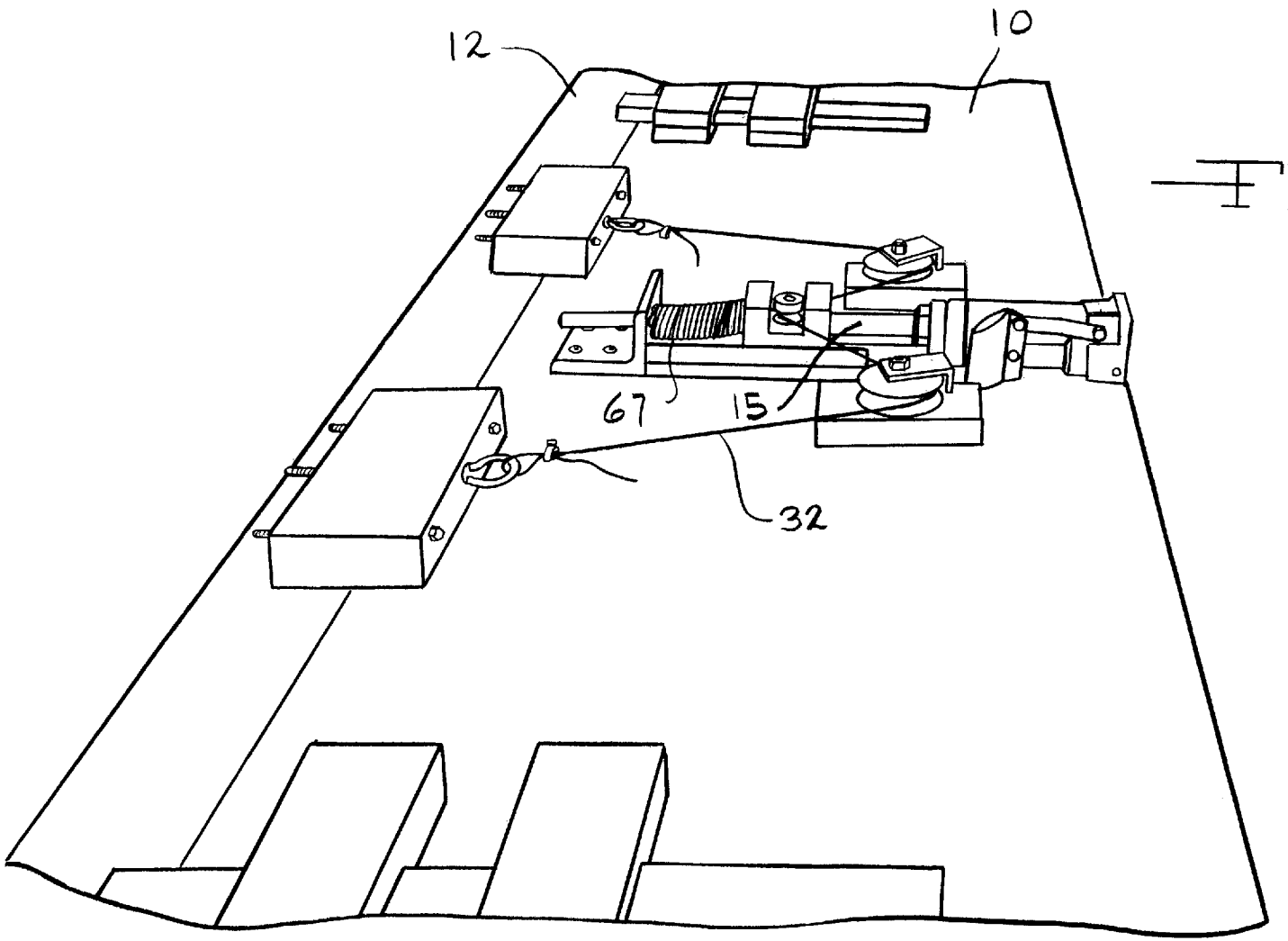
FIG. 4A is a view of the underside of the top in the closed or clamped position.
Figure 5:
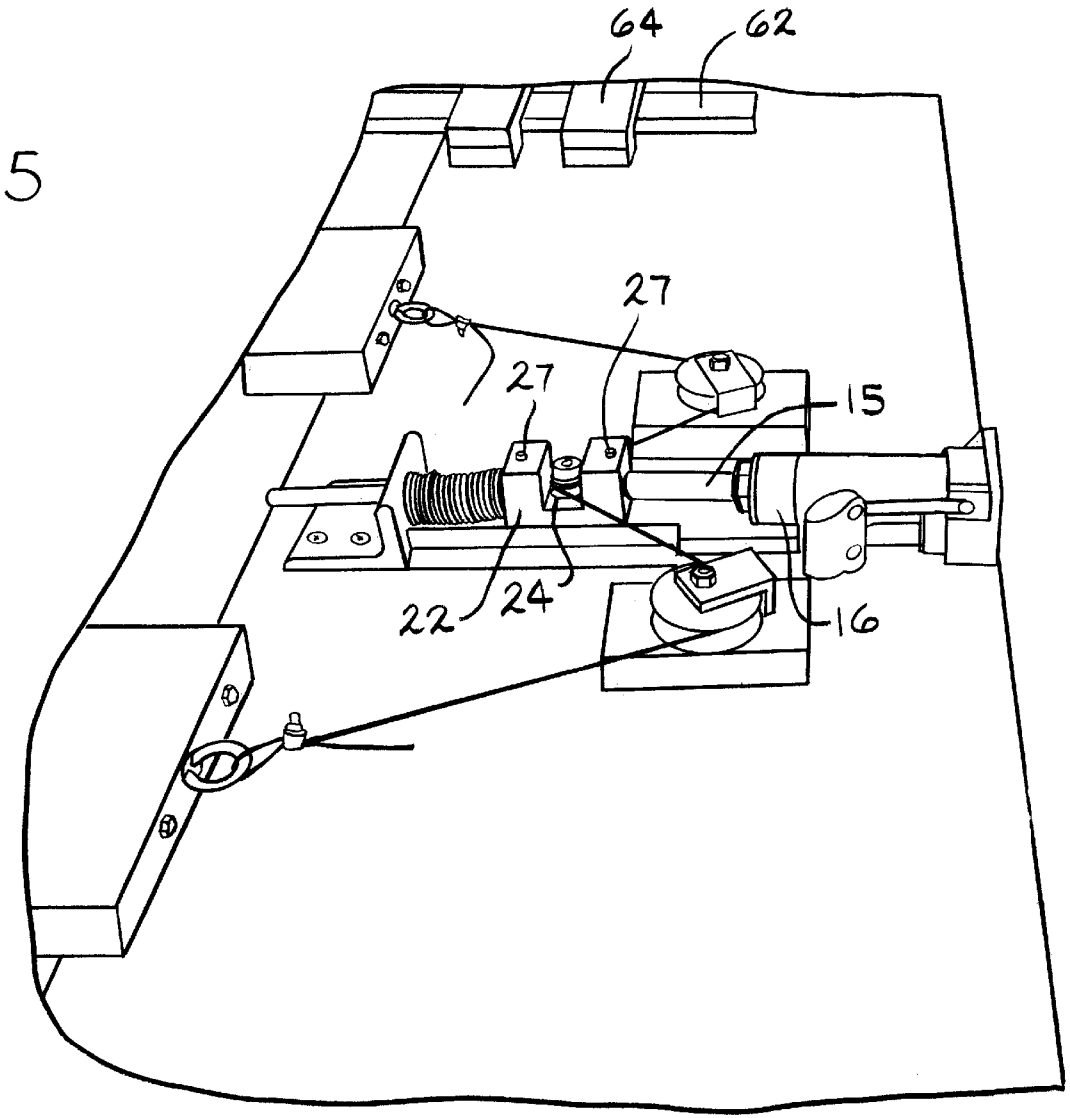
FIGS. 5 and 6 are views of the parts which comprise the operating mechanism for the clamping action.
Figure 6:
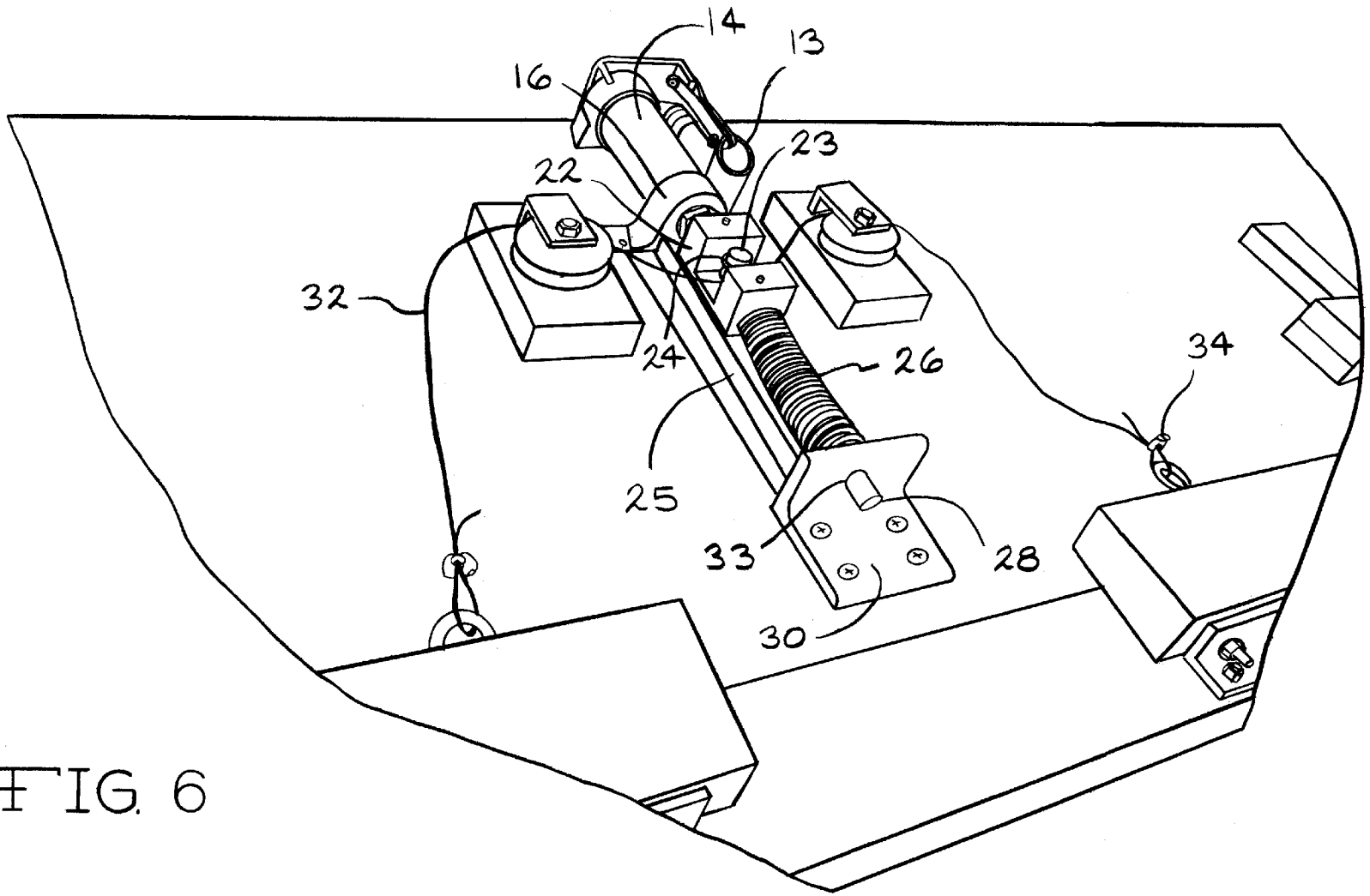
Figure 7:
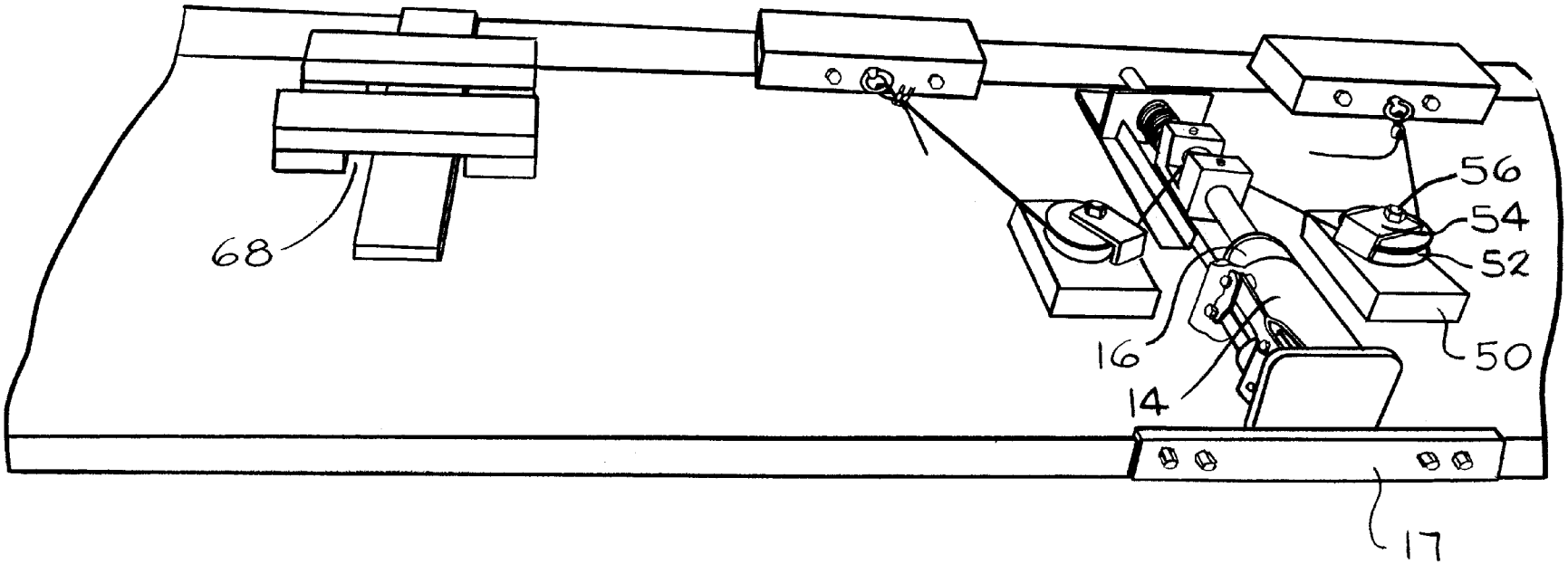
FIGS. 7 and 8 are views of the underside of the workbench top showing the clamping jaw guides and bracket. Also shown are the anchor blocks and pulleys which carry the airplane cable.
Figure 8:
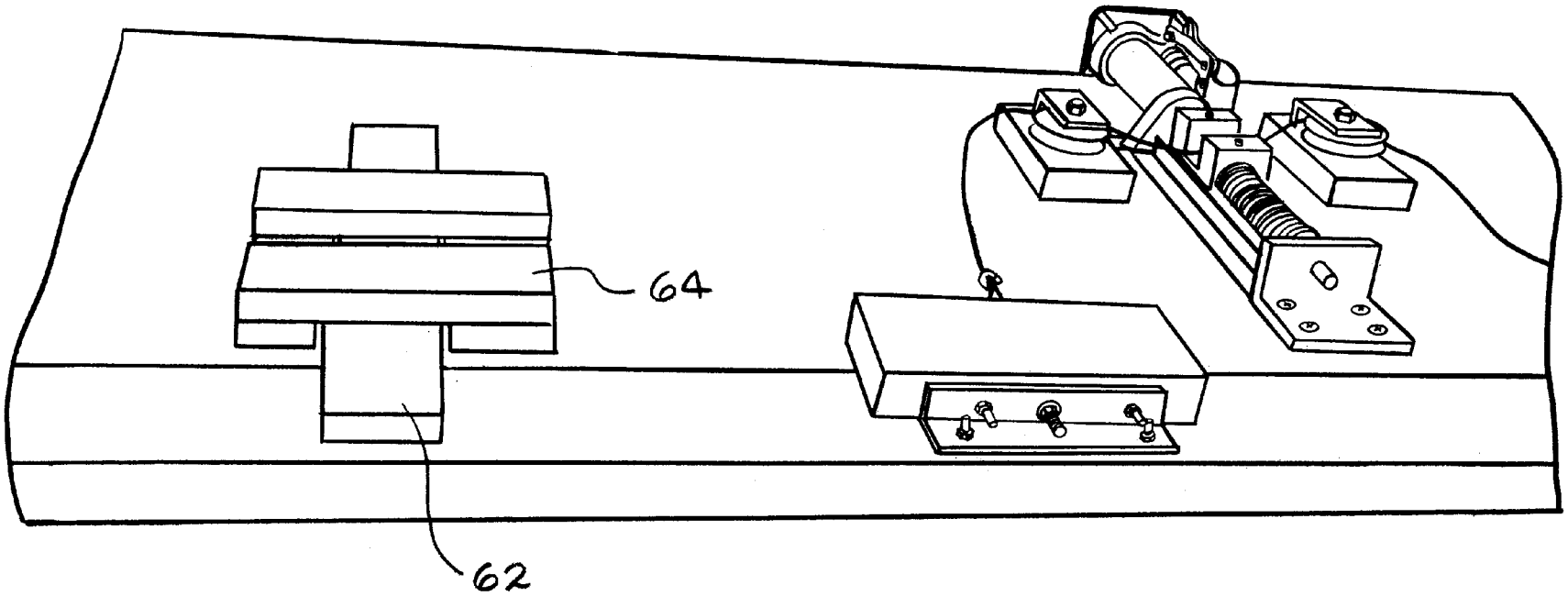
Figure 8A:
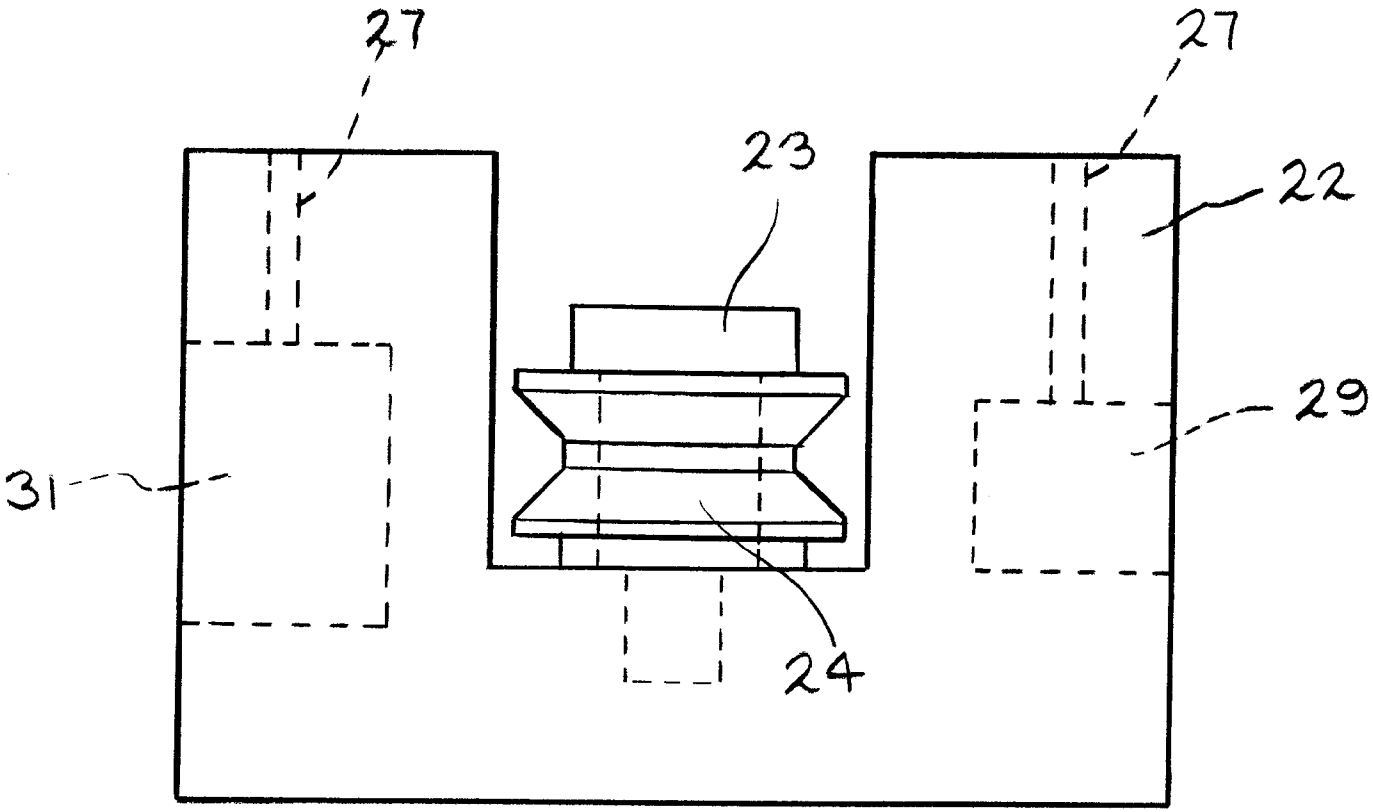
FIG. 8A is a view of the metal saddle block which carries the saddle pulley and is drilled for the jack piston and compression spring 9 guide rod.

Referring to FIG. 3, the workbench top according to my invention includes two sections designated by reference numerals 10 and 12. Both sections of the top to be constructed preferably of hardwood dimension lumber of sufficient thickness to provide the strength and rigidity required for various workbench uses. The total top can be made in various widths and lengths. The narrower front movable section of the top 12 is the same thickness as the wider or main section of the top 10 and the same length. FIG. 3 indicates the attachment of the front or movable section of the top 12 to the main section of the top 10 by airplane cable 32 and cable clamps 34 attached to eye bolts 36. The eye bolts are bolted to iron angle reinforced wooden blocks 38 attached to the underside of the front movable narrow section 12 of the bench top. The front section 12 is also connected to the larger section of the top by wooden guides 62 (FIG. 8) installed on the underside of the front section and guide brackets 64 installed on the underside of the main section. The airplane cable 32 is threaded around pulleys 52 attached to the underside and to the rear of the bench top as shown in FIG. 1. All pulleys used and shown in the drawings are made preferably of nylon as are the pulley mounting bases 50 shown in FIG. 1. The saddle block 22 for the center pulley is preferably made of aluminum and is shown in FIGS. 5 and 6. FIGS. 5 and 6 and 7 indicate the hydraulic power assembly consisting of a hydraulic jack 14 the saddle block 22 the compression spring 26 and compression spring guide rod 28 saddle pulley 24 and the compression spring stop block 30. The jack 14 is securely mounted to the table top FIG. 7 by lag screws inserted through the jack metal bar support 17 into the wooden top and by a metal strap 16 attached over the jack body and to the underside of the table top. The hydraulic jack piston 15 (FIG. 5) is attached to the saddle block by a set screw 27 as is the compression spring guide rod 28. FIG. 8A is the saddle block 22 showing the holes drilled for the hydraulic jack piston 31 and the hole 29 for the compression spring guide rod. The operation of the vise is simple and very effective. With the jack valve 21 in the closed position the jack 14 is operated by a jack handle inserted through the opening provided in the bench top 19 (FIG. 2). The hydraulic jack piston 15 pushes the saddle block 22 forward toward the front of the bench top tightening the airplane cable 32 thus drawing the front member 12 of the work bench tightly to the main or larger section 13 of the top (see FIGS. 4 and 4A). A clamping or vise action is thus created. Simultaneously with the pulling of the front section of the work bench top to the larger portion of the top the action of operating the jack also compresses the return spring shown in FIG. 4A. When the hydraulic jack valve 21 is opened this compression spring pushes the hydraulic jack piston 15 closed thus releasing the tension on the cable 32 (FIG. 4A) and releasing the grip of the clamping jaws 12 of the bench top. With the tension released from the airplane cable the front section of the top, or clamping jaws 12, can be pulled away manually from the larger section of the top 10 and the gap between the two sections can be different on one end than on the other. This allows the insertion of a tapered work piece between the two sections or between bench dogs placed in the two sections of the top. The airplane cable is attached to the eye bolts 36 in the front section of the top as shown in FIG. 1. The cable then moves freely on the three pulleys on the underside of the main section of the top. When the hydraulic power is applied this free movement of the cable allows the vise or clamping jaws to close either on uniform shapes or irregular shaped workpieces inserted in the gap between the two sections 10 and 12 of the top.

NUMBERED PARTS LIST

10 Work Bench Top Section 1
12 Work Bench Top Section 2
13 Jack Operating Lever
14 Hydraulic Jack
15 Hydraulic Jack Piston
16 Jack Hold Down Strap
17 Jack Metal Bar Support
18 Holes for Bench Dogs
19 Port for Insertion of Jack Handle
20 Port to Hydraulic Jack Valve
21 Hydraulic Jack Valve
22 Saddle Block
23 Shoulder Bolt
24 Saddle Pulley
25 Saddle Block Guides
26 Compression Spring
27 Screw Set
28 Compression Spring Guide Rod
29 Hole for compressin spring guide rod
30 Compression Spring Stop Block
31 Hole for Hydraulic Jack Piston
32 Airplane Cable
33 Stop Block Hole for Guide Rod
34 Cable Fastening Clips
36 Cable Anchor Eye Bolt
38 Cable Anchor Block
40 Cable Anchor Block Reinforcing Angle Iron
42 Anchor Bolt
44 Bolt to attach reinforcing Angle to Jaw Section of Top
50 Pulley Mounting Base
52 Pulley
54 Cable Retaining Clip
56 Shoulder Bolt and Nut
58 Washer
62 Clamping Jaw Guide
64 Clamping Jaw Guide Bracket
66 Compression Spring in Open Position
67 Compression Spring in Closed Position
68 Space allowed between clamping jaw guide and guide bracket

What I claim is:

1. A portable work bench top comprising:

a first top member having an upper surface and a second wider top member having an upper surface, said upper surfaces lying in a common substantially horizontal plane;

said top members having respective mutually adjacent side walls defining clamping surfaces;

means for connecting the two members of the top together by cable and pulley arrangements; and means for tightening the cable by hydraulic power supplied by a hydraulic jack whereby the two members of the top are pulled together creating a powerful clamping action.

2. The work bench top of claim 1 having also attached to a bottom of the first top member guides which pass through brackets attached to an underside of the second top member of the top, said brackets having a passageway wider than said guides thus allowing a gap between the two members of the bench top to be greater at one longitudinal end of the gap thus allowing the clamping of tapered or irregular workpieces and; means providing for:

quick release of said clamping action comprising a hydraulic jack valve which can be opened thus allowing the compression spring to force the hydraulic jack piston to the closed position;

the installation of bench dogs in both members of the top so workpieces of various sizes and shapes can be clamped tightly.

* * * * *